US007962969B1

(12) United States Patent
Blakely

(10) Patent No.: US 7,962,969 B1
(45) Date of Patent: Jun. 21, 2011

(54) CUFF CLOSURES FOR DRESS SHIRTS

(76) Inventor: John Ford Blakely, Del Mar, CA (US)

( * ) Notice: Subject to any disclaimer, the term of this patent is extended or adjusted under 35 U.S.C. 154(b) by 289 days.

(21) Appl. No.: 12/231,855

(22) Filed: Sep. 6, 2008

(51) Int. Cl.
*A41B 7/02* (2006.01)

(52) U.S. Cl. ..... 2/123

(58) Field of Classification Search ..... 2/123, 124, 2/128, 59, 60, 170, 16, 265; 24/114.2, 114.11, 24/102, 102 PL, 102 FC, 114.7, 91, 92; D2/858
See application file for complete search history.

(56) References Cited

U.S. PATENT DOCUMENTS

| | | | | | |
|---|---|---|---|---|---|
| 814,328 | A * | 3/1906 | Russell | 24/102 A |
| 1,482,970 | A * | 2/1924 | Cragin | 2/123 |
| 1,567,096 | A * | 12/1925 | Anderton, Jr. | 2/115 |
| 1,594,905 | A * | 8/1926 | Greve | 24/42 |
| 1,691,958 | A * | 11/1928 | Bostick | 2/123 |
| 1,768,381 | A * | 6/1930 | Stewart et al. | 2/128 |
| 1,975,285 | A * | 10/1934 | Pearse | 2/128 |
| 1,989,638 | A * | 1/1935 | Goldschmidt | 2/123 |
| 2,162,536 | A * | 6/1939 | O'Mealia | 2/123 |
| 2,736,032 | A * | 2/1956 | Bode | 2/124 |
| 3,137,861 | A * | 6/1964 | Sanders | 2/123 |
| D341,921 | S * | 12/1993 | Trost | D2/858 |
| D457,291 | S * | 5/2002 | Miller | D2/858 |
| 6,430,747 | B1 * | 8/2002 | Lee | 2/60 |
| 7,155,782 | B2 * | 1/2007 | Napurano | 24/114.1 |

* cited by examiner

*Primary Examiner* — Amy B Vanatta

(57) ABSTRACT

A shirt cuff for a long-sleeved garment including a band of material having first and second opposing edges and first and second opposing cuff ends, wherein the first edge is attached to the sleeve of the shirt. A closure device is comprised of a hidden button and first eyelet combination, respectively disposed separately at the first and second opposing ends. A button-side eyelet may also be disposed adjacent to the hidden button on the first cuff end, and a cuff-link may be placed through the first eyelet and the button-side eyelet to form a French cuff configuration.

10 Claims, 5 Drawing Sheets

CUFF CLOSURES FOR DRESS SHIRTS

BACKGROUND OF THE INVENTION

1. Field of the Invention

This invention relates to a garment securing device, and particularly, to a hidden fabric fastener for securing cuffs for a dress shirt in at least one of a French cuff or overlapping single cuff arrangement.

2. Description of the Related Art

Dress shirt cuffs are typically constructed from at least two different types of arrangements. That is, either a single cuff, or a double cuff configuration (most commonly referred to as French style cuffs). Typical single cuff shirts available on the market have a single button hole in one cuff end, and an eyelet receiving hole in the other cuff end. Consequently, cuff links cannot be used with these traditional standard dress shirts.

Double, or French cuffs, are common in formal settings and are used to fasten the double cuffs ends of the French cuff dress shirt. Cuff-links are typically made from a sturdy shaft having one end fastened to a backing to secure the cuff-link, and the second end of the sturdy shaft fastened to an ornamental cap portion. The ornamental cap portion may be found in a variety of decorative configurations and may be selected and worn by the user as a way for the user to autonomously personalize their dress shirt.

Few apparel enhancements have been made by manufacturers to provide for any adjustability of a conventional dress shirt cuff closures. Traditionally, little has been done to adapt the cuff of a standard dress shirt having a less formal appearance of a single cuff shirt, into one for use as a more formal double, or French cuff appearance, and visa-versa. As a result, there is a need for this type of versatility, and this invention provides a solution to the longstanding need for overcoming the limitations of a cuff of a standard dress shirt.

SUMMARY OF THE INVENTION

The present invention addresses the shortcomings identified in providing a fabric fastener for securing cuffs for a dress shirt.

An object of this invention is to provide a shirt cuff for a long-sleeved garment. The shirt cuff includes a sleeve attached to the shirt cuff. The shirt cuff is composed of a band of material having first and second opposing edges and first and second opposing ends, where the first edge is attached to the sleeve of the shirt. A closure device including a hidden button and eyelet combination, respectively disposed separately at the first and second opposing ends. The hidden button is attached inside of the second end of the shirt cuff. The shirt cuff also includes a second button attached on the outside of the second end of the shirt cuff juxtaposed to the position of the hidden button.

When the shirt cuff is secured closed, the first end of the shirt cuff overlaps the second opposing end of the shirt cuff, and the hidden button placed and secured through the eyelet. However, in another configuration, when the shirt cuff is secured closed, the inside surface of the first end, and the inside surface of the second end of the shirt cuff are placed adjacent to each other in a French cuff configuration, and the hidden button placed and secured through the eyelet.

Yet another aspect of this invention is to provide a shirt cuff for a long-sleeved garment. The shirt cuff includes a sleeve, the shirt cuff and a closure mechanism. The shirt cuff includes a band of material having first and second opposing edges and first and second opposing ends, where the first edge is attached to the sleeve of the shirt. The closure device includes a button and first eyelet combination, respectively disposed separately at the first and second opposing ends. Also included is a button-side eyelet disposed adjacent to the button on the first end. The first eyelet and the button-side eyelet are placed adjacent to each other in a French cuff configuration, and the cuff-link is disposed and secured within the first eyelet and the button-side eyelet.

The invention also discloses a pivoting button that pivots from a first position outside of the cuff, to a second position located inside of the cuff. The shirt cuff is attached by a threaded attachment to the cuff at one edge of the button-side eyelet.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein.

DETAILED DESCRIPTION OF EXEMPLARY EMBODIMENTS

Particular embodiments of the present invention will now be described in greater detail with reference to the figures.

Figure 1:
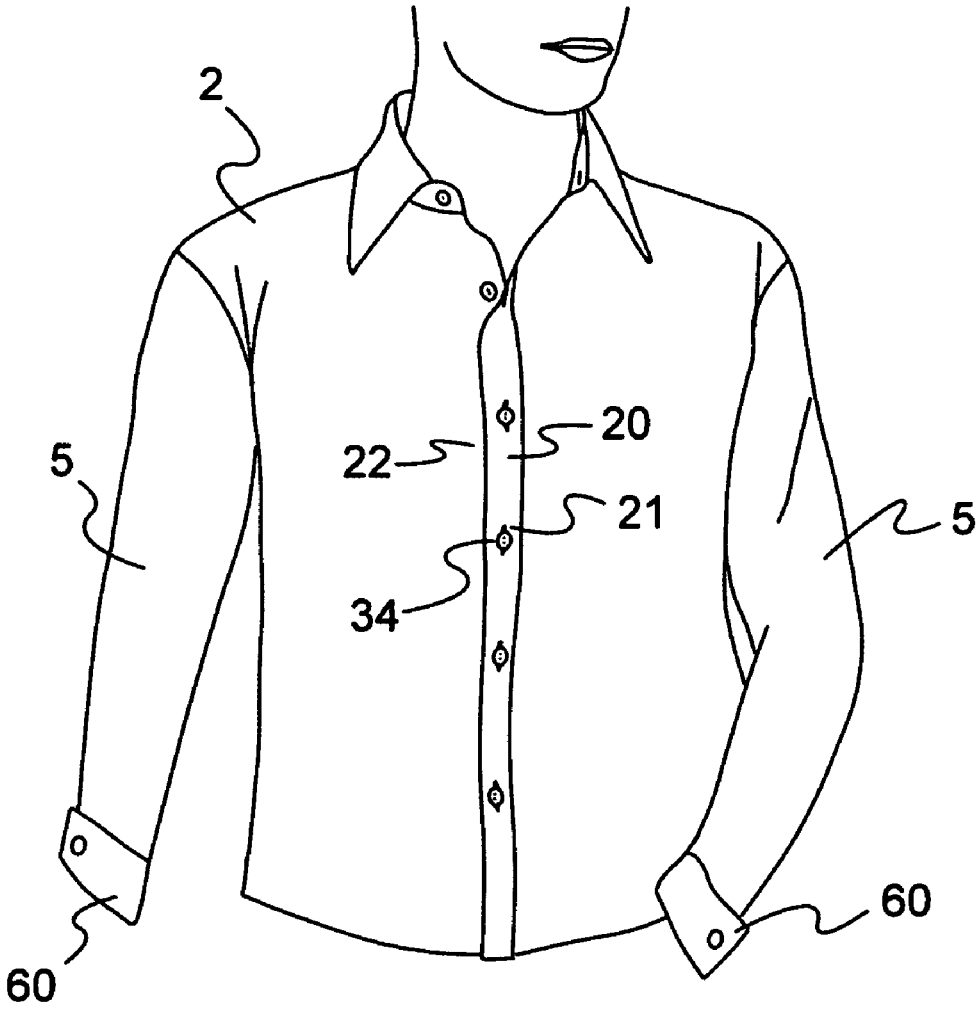
FIG. 1 is an exemplary illustration of dress shirt.

FIG. 1 is an exemplary illustration of a traditional dress shirt 2. As shown, the dress shirt 2 includes a front shirt panel 20 and a rear shirt panel 22. The front shirt panel 20 is shown attached to the rear shirt panel 22 with a plurality of fasteners 34 and associated eyelet holes 21 adapted to receive the various fasteners. The various fasteners secure the dress shirt 2 to the torso of the user. The dress shirt 2 also includes a pair of shirt cuffs 60 attached to a pair of shirt sleeves 5.

The shirt cuff 60 includes a band of material 12 having a first edge 14 and an opposing second edge 16. The first edge 14 is attached to the sleeve 5 of the shirt 2. Each of the shirt cuffs 60 includes a first cuff end 60*a* and a second cuff end 60*b*.

Figure 2:
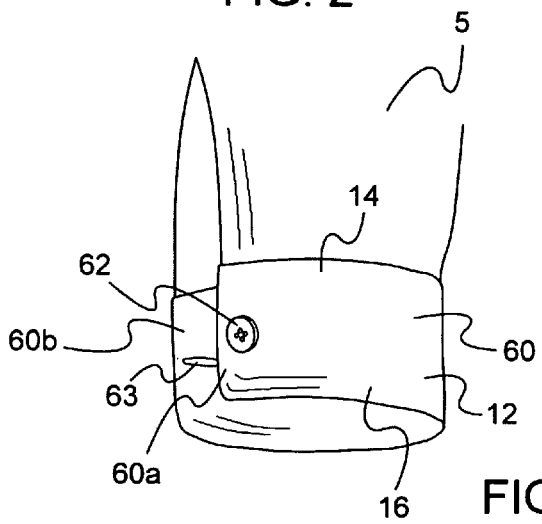
FIG. 2 is an exemplary illustration of dress shirt cuff including an outer button and mating eyelet.

FIG. 2 is an exemplary illustration of the dress shirt sleeve 5 attached to the dress shirt cuff 60. As shown, the shirt cuff 60 includes an outer button 62 and a receiving cuff eyelet 63. An aspect of this invention is to include an inner cuff button 65, alone or in combination, with the outer button 62.

Figure 3:
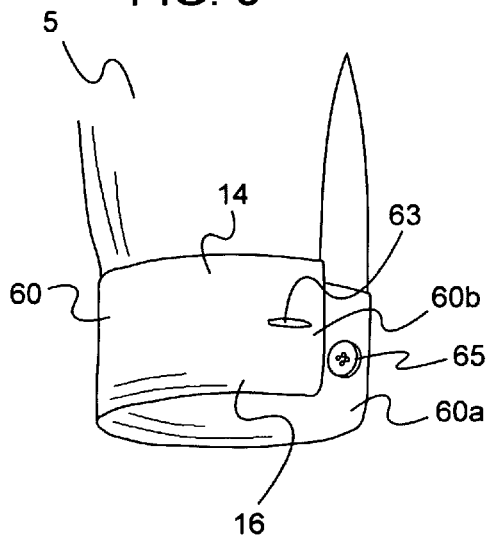
FIG. 3 is an exemplary illustration of an inner hidden cuff button in accordance with this invention.

FIG. 3 illustrates depicts the inner cuff button 65 disposed on an inside of the cuff 60 adjacent to the first cuff end 60*a*. The inner cuff button 65 is aligned to be received by the cuff eyelet 63. The cuff 60 may be configured for use in a variety of different arrangements by employing the use of the inner cuff button 65, as will be described below.

Figure 4:
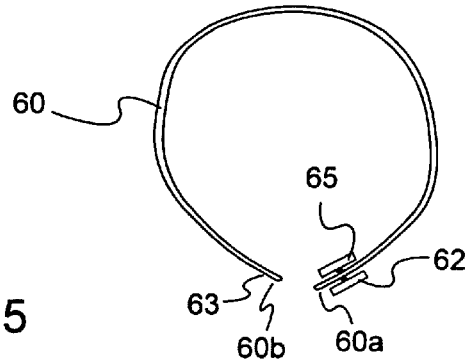
FIG. 4 is a side view depicting the outer cuff button and the inner hidden cuff button in an open position accordance with this invention.
Figure 5:
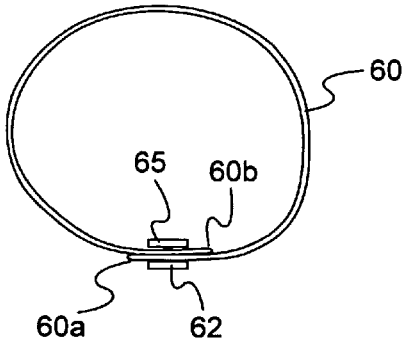
FIG. 5 is a side end view depicting the cuff being arranged for use with the inner hidden cuff button in an overlapping first position in accordance with this invention.
Figure 6:
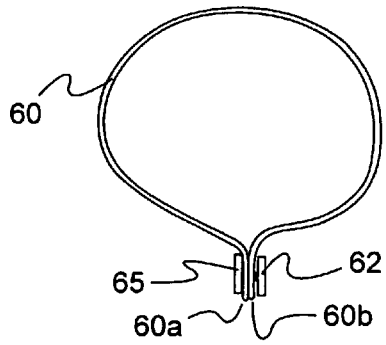
FIG. 6 is a side view depicting the cuff being arranged for use with the inner hidden cuff button in a French cuff-link configuration in accordance with this invention.

FIGS. 4-6 illustrate the various configurations in which the inner cuff button 65 may be arranged. FIG. 4, for example, illustrates the cuff 60 in an open position ready for use. As shown, the outer button 62 and the inner cuff button 65 are disposed substantial adjacent to each other in an overlapping fashion on the cuff 60.

FIG. 5 is a side view depicting the cuff 60 being arranged so that the inner cuff button 65 on the first cuff end 60*a* is secured to the cuff eyelet 63 on the second cuff end 60*b*. In particular, the inner cuff button 65 is secured to the cuff eyelet 63 adjacent to the second cuff end 60*b* so that the cuff 60 is arranged in a conventional overlapping configuration as shown in FIG. 5. By way of example, the versatility of this invention may be demonstrated in that the outer button 62 may be placed through the cuff eyelet 63 (not shown) as is done with dress shirts having conventional outer buttons and associated eyelets. In use, the cuff button 65 is pushed through the outer surface of the second cuff end 60*b* toward the inner surface of the cuff 60 in accordance with this invention. This construction yields the appearance of a traditional overlapping dress shirt cuff securing construction.

FIG. 6 is a side view depicting the cuff 60 in a French cuff configuration. As shown, the inner cuff button 65 is adapted to secure the first cuff end 60*a* to the second cuff end 60*b*. In use, the inner cuff button 65 is secured to the cuff eyelet 63 adjacent to the second cuff end 60*b*. However, in this illustration, the cuff button 65 is pushed through the inner surface of the first cuff end 60*a* toward the outward surface of the cuff 60 in accordance with this invention. This construction yields the appearance of a formal French cuff dress shirt appearance including the likeness of a cuff-link appearance.

Although the outer button 62 is shown, it is not necessary to fasten the outer button 62. Instead, an ornamental accessory, design, or the like, may be disposed in its place. Furthermore, it is to be understood that the placement of the inner cuff button 65 and the cuff eyelet 63 may be reversed in accordance with this invention.

Figure 7:
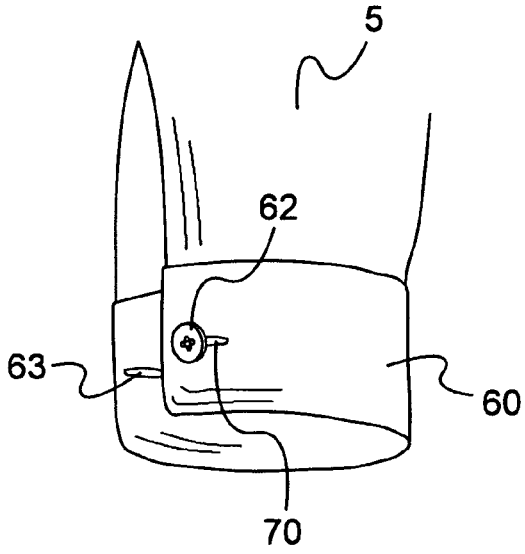
FIG. 7 is an exemplary illustration of dress shirt cuff including an additional button-side cuff-link eyelet and outer button in accordance with this invention.

FIG. 7 is an exemplary illustration of an outer view of the sleeve 5 and dress shirt cuff 60 including an additional cuff-link eyelet 70. The cuff-link eyelet 70 is disposed adjacent to the first cuff end 60*a* in accordance with this invention. The cuff-link eyelet 70 on the first cuff end 60*a* is located at a predetermined position adjacent to the outer button 62 and aligned with the cuff eyelet 63 on the second cuff end 60*b*.

Figure 8:
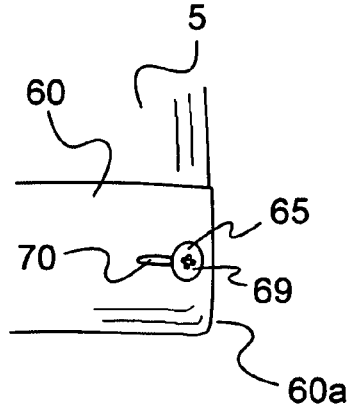
FIG. 8 is an exemplary illustration of an inside view of the dress shirt cuff depicting the additional button-side cuff-link eyelet and an inside button in accordance with this invention.

FIG. 8 is an exemplary illustration of an inside view of the dress shirt cuff 60 depicting the additional button side cuff-link eyelet 70 and the inner button 65 sewn 69 adjacent to the first cuff end 60*a* of the cuff 60 in accordance with this invention. As shown in FIGS. 7-8, it is possible to dispose the inner button 65 and the outer button 62 on the first cuff end 60*a* of the cuff 60.

Figure 9:
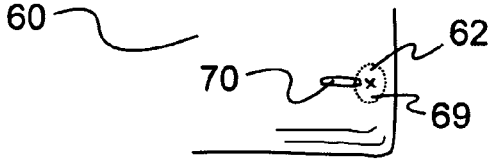
FIG. 9 is an exemplary illustration of an inside view of the dress shirt cuff depicting the additional button-side cuff-link eyelet and without the inside button in accordance with this invention.

FIG. 9 shows an alternative exemplary embodiment of the inside of the dress shirt cuff 60 depicting the additional button side cuff-link eyelet 70 without the inner button 65 sewn 69 adjacent to the first cuff end 60*a* of the cuff 60. It is to be understood that various configurations may be selected in accordance with this invention.

Figure 10:
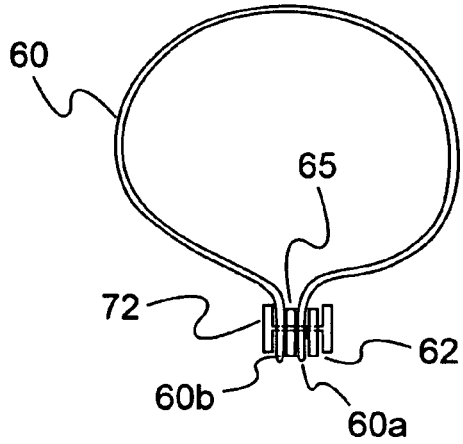
FIG. 10 is an exemplary illustration of a side view of the cuff in a French style cuff having a cuff-link disposed through the additional button-side cuff-link eyelet and the cuff button eyelet in accordance with this invention.

FIG. 10 is an exemplary illustration of an end view of the cuff 60 including a cuff-link 72 disposed through the button side cuff-link eyelet 70 (as shown in FIGS. 7-8) and the regular cuff button eyelet 63 (as shown in FIG. 7) in accordance with this invention. In particular, FIG. 6 depicts the cuff 60 arranged such that the additional button side cuff-link eyelet 70 and the regular cuff button eyelet 63 are aligned so that when a cuff-link 72 is provided, the cuff-link 72 may easily be extended through both the cuff-link eyelet 70 and the regular cuff button eyelet 63. This construction allows for a more formal appearance of a traditional French cuff dress shirt that included a cuff-link. According to this invention, this use and implementation may be made at a fraction of the cost of a more expensive French cuff dress shirt sleeve 5, which is specifically designed for use with cuff-links 72. The advantage of this construction is that by integrating the cuff-link eyelet 70 into the cuff 60, the dress shirt 2 may be worn casually, as a regular dress shirt, or more formally as a French cuff dress shirt as shown in FIG. 10.

Figure 11:
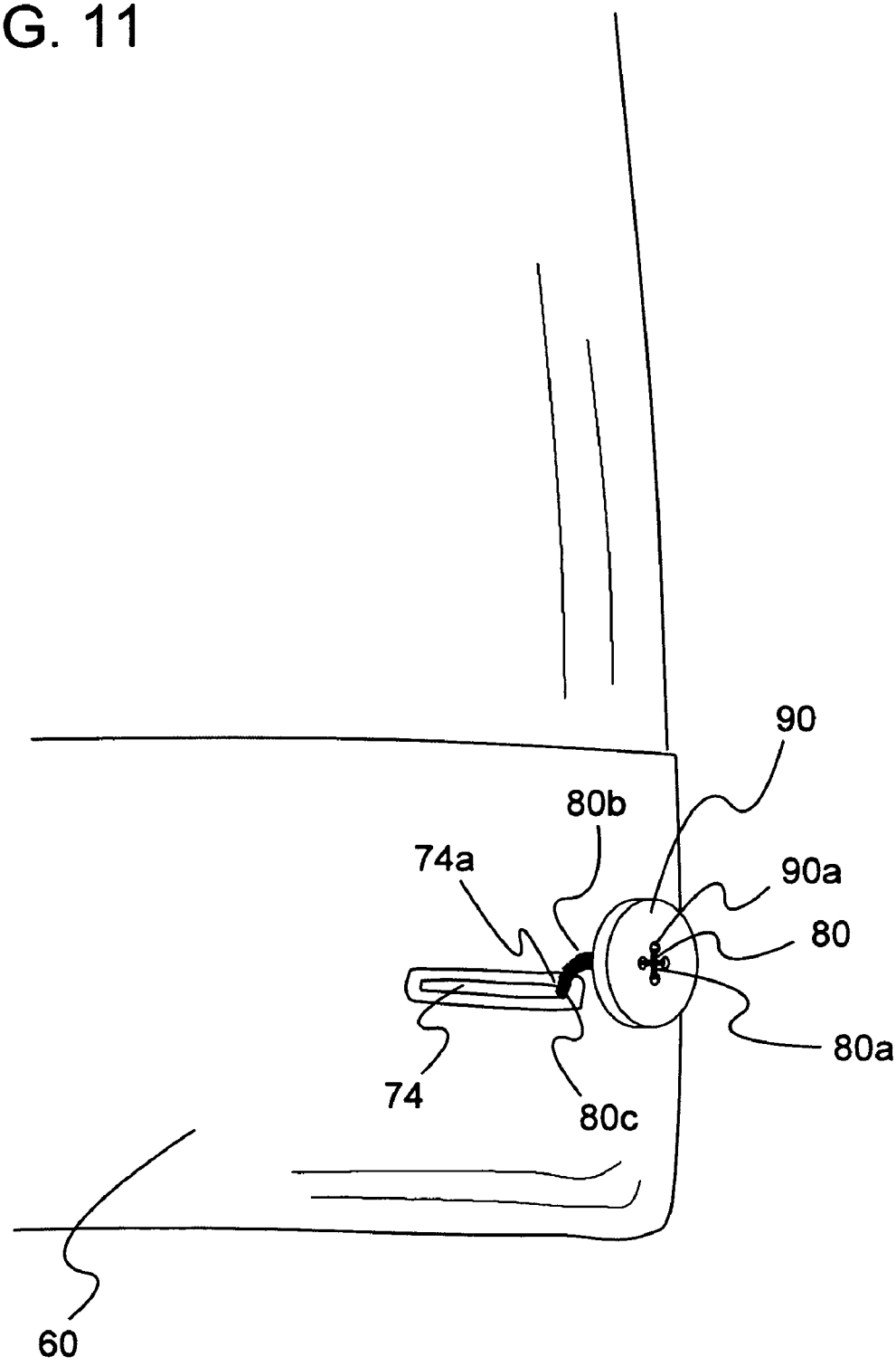
FIG. 11 is an exemplary illustration of a pivoting cuff button in accordance with this invention.

FIG. 11 illustrates another exemplary illustration of a pivoting cuff button 90 in accordance with this invention. The pivoting cuff button 90 is fastened to the cuff 60 at one edge 74*a* of a button eyelet 74. The pivoting cuff button 90 is attached to the button eyelet 74 by a threaded attachment 80.

A first portion 80*a* of the threaded attachment 80 secures the pivoting button 90 though button holes 90*a* in the pivoting button 90. The threaded attachment 80 is combined behind the pivoting button 90 into a threaded extension 80*b*. The threaded extension 80*b* formed extends from the pivoting button 90 to the edge of 74*a* of the button eyelet 74. The threaded attachment 80 is secured at a threaded attachment point 80*c* to the edge of 74*a* of the button eyelet 74. Although the threaded attachment point 80*c* is shown attached to a lower edge of 74*a* of the button eyelet 74, it is to be understood that the threaded attachment point 80*c* may be secured anywhere contemporaneously close to the button eyelet 74 so long as the pivoting button 90 can pivot into and out of the button eyelet 74 as will be described below.

Figure 12:
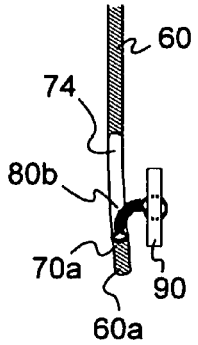
FIG. 12 is an exemplary illustration of a pivoting cuff button in a first position in accordance with this invention.
Figure 13:
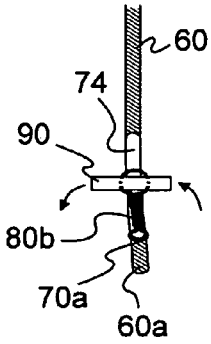
FIG. 13 is an exemplary illustration of a pivoting cuff button in an intermediate pivot position in accordance with this invention.
Figure 17:
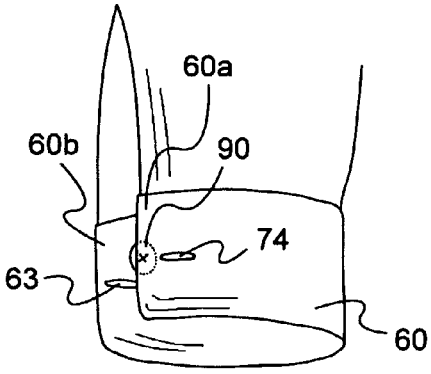
FIGS. 17-18 illustrate the pivoting button in the second position in accordance with this invention.
Figure 18:
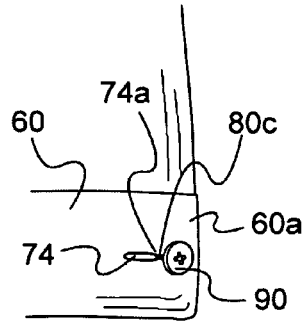
Figure 14:
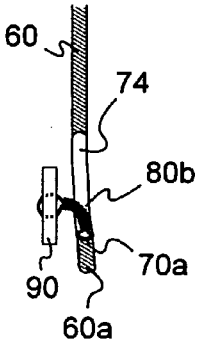
FIG. 14 is an exemplary illustration of a pivoting cuff button in a second position in accordance with this invention.

FIGS. 12-14 demonstrate the operation of the pivoting cuff button 90 from a first position (as shown in FIG. 12) in which the pivoting cuff button 90 is positioned on the outside of the cuff 60, through a intermediate position (as shown in FIG. 13), to a second position (as shown in FIG. 14) in which the pivoting cuff button 90 is positioned on the inside of the cuff 60.

Figure 15:
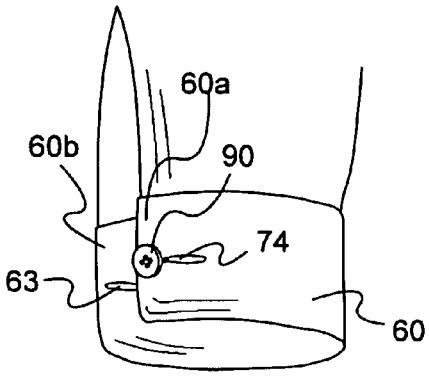
FIGS. 15-16 illustrate the pivoting button in the first position in accordance with this invention.
Figure 16:
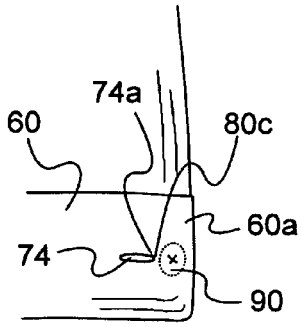

In particular, when a user prefers to wear the cuffs 60 as a traditional dress shirt, the pivoting button 90 may be positioned on the outside of the cuff 60 as shown in FIG. 15. FIGS. 15-16 show the pivoting button 90 located in the first position.

In the alternative, when the user prefers to wear the cuffs 60 as a formal French cuff style dress shirt, the pivoting button 90 may be pivoted from the first position shown in FIGS. 12 and 15-16, through the button eyelet 74 as shown in FIG. 13 and repositioned inside of the cuff 60 as shown in FIG. 14. FIGS. 14 and 17-19 depict the pivoting button 90 located in the second position.

Figure 19:
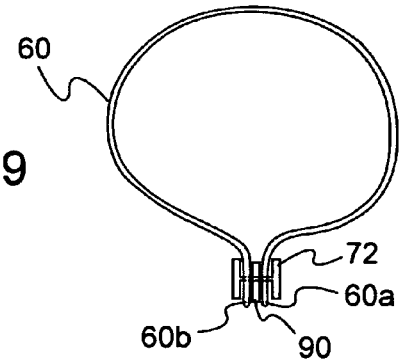
FIG. 19 illustrates exemplary illustration of a side view of the cuff including a cuff-link disposed through the button eyelet and the regular cuff button eyelet in accordance with this invention.

FIG. 19 illustrates an exemplary illustration of an side end view of the cuff 60 including a cuff-link 72 disposed through the button eyelet 74 and the regular cuff button eyelet 63 in accordance with this invention.

As shown in FIG. 19, the pivoting button 90 is disposed between the first cuff end 60*a* and the second cuff end 60*b*. In position, the pivoting button 90 is tucked away between the ends of the folded cuff 60 and a more formal appearance of a traditional French cuff dress shirt is rendered. The advantage of this construction is that a more formal French cuff appearance may be achieved at a relatively inexpensive cost. Likewise, the dress shirt 2 is very versatile and may be selectively worn as a semi-formal garment and/or as a formal dress shirt including French cuffs.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A non-reversible shirt cuff, comprising:
- a sleeve;
- the shirt cuff configured as a French cuff comprising a band of material having a first edge and an opposing second edge, and a first cuff end and an opposing second cuff end, wherein the first edge is attached to the sleeve of the shirt and the opposing second edge is fixedly extended outward;
- a closure device for the shirt cuff comprising:
  - a pivoting button and an associated eyelet, disposed separately at the first and second opposing cuff ends; and
  - a button-side eyelet onto which the pivoting button is pivotally fastened to an edge of the button-side eyelet,
  - the pivoting button is pivoted inside the French cuff, and in a worn position disposed between inside surfaces of the first cuff end and the second cuff end; and
- a cuff-link is disposed through the eyelets in the French cuff.

2. The non-reversible shirt cuff as recited in claim 1, wherein the pivoting button is pivotally fastened by a threaded attachment to the edge of the button-side eyelet.

3. The non-reversible shirt cuff as recited in claim 2, wherein the threaded attachment comprises:
- a first threaded portion that secures the pivoting button through button holes in the pivoting button;
- a second threaded portion defining a threaded extension in which the first threaded portion is combined on the back side of the pivoting button to define the second threaded portion; and
- a third threaded portion defining a threaded attachment point in which the threaded extension is secured to the edge of the button-side eyelet.

4. A non-reversible shirt cuff, comprising:
- a sleeve;
- a French shirt cuff comprising:
  - a band of material having a first edge and an opposing second edge, and a first cuff end and an opposing second cuff end, wherein the first edge is attached to the sleeve of the shirt, and the opposing second edge is fixedly extended outward;
  - a closure device for the French shirt cuff comprising:
    - a button-side eyelet and an opposing eyelet disposed separately at the first and second opposing cuff ends; and
    - a pivoting button pivotally fastened to an edge of the button-side eyelet,
    - wherein the pivoting button is adapted to pivot from:
      - a first worn position outside of the first cuff end; and
      - a second worn position disposed between inside surfaces of the first cuff end and a second cuff end.

5. The non-reversible shirt cuff as recited in claim 4, wherein a cuff-link is disposed through the button-side eyelet and the opposing eyelet of the French shirt cuff.

6. The non-reversible shirt cuff as recited in claim 4, wherein the pivoting button is pivotally fastened by a threaded attachment to the edge of the button-side eyelet.

7. The non-reversible shirt cuff as recited in claim 4, wherein the threaded attachment comprises:
- a first threaded portion that secures the pivoting button through button holes in the pivoting button;
- a second threaded portion defining a threaded extension in which the first threaded portion is combined on the back side of the pivoting button to define the second threaded portion; and
- a third threaded portion defining a threaded attachment point in which the threaded extension is secured to the edge of the button-side eyelet.

8. The non-reversible shirt cuff as recited in claim 7, wherein the threaded extension of the second threaded portion is long enough to pivot through the button-side eyelet from a first position outside of the cuff, to a second position located inside of the cuff.

9. A shirt cuff, comprising:
- a sleeve;
- a French shirt cuff comprising:
  - a band of material having a first edge and an opposing second edge, and a first cuff end and an opposing second cuff end, wherein the first edge is attached to the sleeve of the shirt, and the opposing second edge permanently extending outward;
  - a closure device for the French shirt cuff comprising:
    - a button-side eyelet and an opposing eyelet disposed separately at the first and second opposing cuff ends; and
    - a pivoting button pivotally fastened to an edge of the button-side eyelet,
    - wherein the pivoting button is in a worn position disposed between inside surfaces of the first cuff and the second cuff.

10. The shirt cuff as recited in claim 9, wherein a cuff-link is disposed through the button-side eyelet and the opposing eyelet of the French shirt cuff.

* * * * *